US007658279B2

(12) United States Patent
Oka et al.

(10) Patent No.: US 7,658,279 B2
(45) Date of Patent: Feb. 9, 2010

(54) MEDICAL MULTI-CHAMBER CONTAINER

(75) Inventors: Minoru Oka, Tokushima (JP); Masaru Ohnishi, Tokushima (JP); Shin Hamazaki, Tokushima (JP); Osamu Nakao, Naruto (JP); Yoshihiro Sugioka, Tokushima (JP)

(73) Assignee: Otsuka Pharmaceutical Factory Inc., Naruto-shi (JP)

( * ) Notice: Subject to any disclaimer, the term of this patent is extended or adjusted under 35 U.S.C. 154(b) by 414 days.

(21) Appl. No.: 10/503,133

(22) PCT Filed: Jan. 8, 2003

(86) PCT No.: PCT/JP03/00058

§ 371 (c)(1),
(2), (4) Date: Aug. 10, 2004

(87) PCT Pub. No.: WO03/068136

PCT Pub. Date: Aug. 21, 2003

(65) Prior Publication Data

US 2005/0087456 A1 Apr. 28, 2005

(30) Foreign Application Priority Data

Feb. 14, 2002 (JP) ..... 2002-037016

(51) Int. Cl.
*B65D 25/08* (2006.01)
*B65D 33/00* (2006.01)

(52) U.S. Cl. ..... 206/219; 206/828; 383/200; 383/38; 383/906

(58) Field of Classification Search ..... 206/219, 206/828; 383/200, 207, 38, 904, 906
See application file for complete search history.

(56) References Cited

U.S. PATENT DOCUMENTS 3,608,709 A 9/1971 Pike ..... 206/47

(Continued)

FOREIGN PATENT DOCUMENTS

EP 0698487 2/1996

(Continued)

OTHER PUBLICATIONS

Supplementary European Search Report dated Jan. 16, 2007.

*Primary Examiner*—Jila M Mohandesi
(74) *Attorney, Agent, or Firm*—Kratz, Quintos & Hanson, LLP

(57) ABSTRACT

A medical multi-chamber container (1) comprising a container body (3) having first and second chambers (10, 11) for storing medicaments, a weak partition seal (20) for portioning the charmers (10, 11) from each other, and an outlet (32) fitted into the container body (3) for allowing the medicaments to be delivered from the second chamber (11), the container body (3) further comprising a weak discharge seal (21) partitioning the second chamber (11) from the outlet (32) and unsealably formed so as to allow the chambers (10, 11) to communicate with each other when used, characterized in that the unsealing strength of the weak discharge seal (21) is less than that of the weak partition seal (20).

11 Claims, 11 Drawing Sheets

U.S. PATENT DOCUMENTS

| | | | | |
|---|---|---|---|---|
| 4,458,811 | A | 7/1984 | Wilkinson | 206/219 |
| 4,465,488 | A | 8/1984 | Richmond et al. | 604/414 |
| 4,519,499 | A | 5/1985 | Stone et al. | 206/219 |
| 4,711,359 | A | 12/1987 | White et al. | 215/11.1 |
| 5,176,634 | A | 1/1993 | Smith et al. | 604/87 |
| 5,462,526 | A | 10/1995 | Barney et al. | 604/85 |
| 5,910,138 | A | 6/1999 | Sperko et al. | 604/408 |
| 5,928,213 | A | 7/1999 | Barney et al. | 604/410 |
| 5,944,709 | A | 8/1999 | Barney et al. | 604/410 |
| 6,007,529 | A | 12/1999 | Gustafsson et al. | 604/410 |
| 6,017,598 | A | 1/2000 | Kreischer et al. | 428/35.4 |
| 6,117,123 | A | 9/2000 | Barney et al. | 604/410 |
| 6,165,161 | A | 12/2000 | York et al. | 604/408 |
| 6,198,106 | B1 | 3/2001 | Barney et al. | 250/453.11 |
| 6,203,535 | B1 | 3/2001 | Barney et al. | 604/408 |
| 6,398,771 | B1 | 6/2002 | Gustafsson et al. | 604/410 |
| 7,040,483 | B2 * | 5/2006 | Inuzuka et al. | 206/219 |

FOREIGN PATENT DOCUMENTS

| | | |
|---|---|---|
| EP | 1101483 | 5/2001 |
| GB | 2134067 | 8/1984 |
| JP | 1-240469 | 9/1989 |
| JP | 01-240469 | 9/1989 |
| JP | 04-53678 | 5/1992 |
| JP | 96381/1990 | 5/1992 |
| JP | 05-509025 | 12/1993 |
| JP | 5-509025 | 12/1993 |
| JP | 09-327498 | 12/1997 |
| JP | 2001-187111 | 7/2001 |
| JP | 2002-136570 | 5/2002 |
| JP | 14-37016 | 6/2003 |
| KR | 2001-0031996 | 4/2008 |
| WO | WO/92/02271 | 2/1992 |
| WO | WO97/42897 | 11/1997 |
| WO | WO99/23966 | 5/1999 |
| WO | WO99/24086 | 5/1999 |
| WO | WO 99/24086 A1 | 5/1999 |

* cited by examiner (a)

(b)

(a)

(b)

MEDICAL MULTI-CHAMBER CONTAINER

TECHNICAL FIELD

The present invention relates to a medical container having multiple chambers for individually storing various unstable medicaments (liquid, powder or solid agents) which would deteriorate with time if mixed together, wherein the medicaments stored in the chambers can be mixed together aseptically without forming any foreign matter by peeling apart a partition seal separating the chambers.

BACKGROUND ART

Some medicaments that are administered to a patient by intravenous injection are unstable and undesirably deteriorate over time if they have been mixed beforehand. For example, when an amino acid transfusion solution and a glucose transfusion solution are mixed and stored, the mixed solution will become brown due to the so-called Maillard reaction. When a fat emulsion is mixed with an electrolytic solution and stored, the fat component will cause coagulation. When a phosphoric acid-containing solution and a calcium-containing solution are mixed, the precipitation of calcium phosphate will result in undesirable changes.

For the storage of such medicaments, a medical container having multiple chambers, in which components can be individually contained prior to being mixed, is often used. FIG. 10 is a plan view showing an example of such a conventional multiple-chamber medical container. FIG. 11 is a cross-sectional view taken along the line X-X of FIG. 10.

The multiple-chamber medical container has chambers 10 and 11 for storing each of two medicaments that should not be mixed or dissolved beforehand. A weak partition seal 20 is disposed to separate the chambers 10 and 11, ensuring that the medicaments in the chambers 10 and 11 can be isolated from each other and stored safely and reliably until administration. A suspension hole 30 is located on the upper end of the container, and an outlet 32 is provided on the lower end of the container to discharge the medicaments from the chamber 11. A rubber plug (not shown) is disposed inside of the outlet 32, thereby preventing discharge of the medicament from the chamber 11 during storage.

The weak partition seal 20 is formed so as to be openable when the internal pressure of the chamber 10 and/or 11 is increased. At the time of use, pressure is applied to either of the chambers 10 or 11 to open the weak partition seal 20, causing the chambers 10 and 11 to communicate with each other and the medicaments a and b to quickly mix or dissolve. To administer the mixed medicament to a patient, the container is hung from a support post or the like by the suspension hole 30, and an infusion tube is then inserted into the rubber plug provided at the end of the container. The mixed medicament in the container can be thereby administered to the patient through the infusion tube.

In such a multiple-chamber medical container, however, a medicament in liquid state is often contained in the chamber 11 to which the outlet 32 is attached. Accordingly, if an infusion tube is inserted into the rubber plug before opening the weak partition seal 20, the medicament may be discharged from the outlet 32 prior to being mixed.

The present invention has been accomplished to solve the problems described above, with an object of the present invention being to provide a multiple-chamber medical container that reliably prevents the discharge of medicaments from the outlet prior to being mixed.

DISCLOSURE OF THE INVENTION

The above object of the present invention can be achieved by a multiple-chamber medical container comprising: a container body having multiple chambers for storing medicaments and a partition seal separating the chambers from each other; and an outlet attached to the container body for allowing the medicaments to be discharged from one of the chambers, wherein the partition seal is openable so that the chambers may communicate with each other at the time of use; the container body comprises a discharge seal that separates at least one chamber from the outlet and is openable at the time of use, and the unsealing strength of the discharge seal is less than that of the partition seal.

In this structure, the weak discharge seal is provided so that the second chamber and the outlet do not directly communicate with each other. Therefore, even if a needle from infusion tube is accidentally inserted into the outlet before the weak partition seal is opened, the medicament in the chamber can be prevented from flowing out of the outlet before being mixed. In this case, since the medicament does not discharge from the outlet even when a needle is inserted, users can recognize that the weak discharge seal and the weak partition seal are not opened. Accordingly, providing the weak discharge seal can safeguard proper use, i.e., the weak partition seal is opened to mix the medicaments in the chambers, and the medicament mixture is administered by inserting a needle from an infusion tube into the outlet.

Because the discharge seal has an unsealing strength lower than that of the partition seal, the following effects can be achieved by the use thereof. The medical multi-chamber container is used in such a manner, for example, that the partition seal is opened to mix the medicaments in the chambers, and the discharge seal is then opened to discharge the medicaments from the outlet. At this time, it is necessary to apply pressure to the discharge seal by pressing the entire surface of the communicated chambers to open the discharge seal, and if it is difficult to open, complicated operations become necessary, such as pressing the container while rolling it up, etc. If the unsealing strength of the discharge seal is made less than that of the partition seal, even when the pressed area is wide, for example, all of the chambers are pressed as described above, it is possible to readily open the discharge seal.

The difference in the unsealing strength between the two seals may be set so that the pressing force required to open the partition seal, when pressing a disc having a diameter of 100 mm against the container body, is greater than that of the discharge seal by 5-10 kg. Providing such a difference in the unsealing strength makes is possible to readily open the discharge seal.

The above medical multi-chamber container may be constructed so that at least an innermost layer of the container body comprises a film prepared from a mixture of two or more kinds of thermoplastics having low miscibility with one another and different melting points, the peripheral portion thereof being heat-sealed to form the container body in the shape of a bag, the partition seal and the discharge seal being formed by heat-sealing the surfaces of the film of the container body that are facing each other, and the partition seal having a sealing strength lower than that of the peripheral portion of the container body and higher than that of the discharge seal. It is especially preferable that at least the innermost layer of the container body be formed from a film prepared from a mixture of polyethylene and polypropylene or of polyethylene and a cyclic olefin resin. By forming the container body from polyethylene, etc., it is possible to form the seal by heat sealing, and therefore the container can be produced easily.

The unsealing strength of the discharge seal can be made less than that of the partition seal by, for example, making at least one portion of the discharge seal narrower than the partition seal.

It is possible to form the discharge seal arcwise around the outlet. This decreases the sealed area, reducing the production time and cost. Because the sealed area is small, creases are not readily produced in the sealed portion, reducing the fraction defective.

In the medical multi-chamber container, it is preferable that the discharge seal further comprise a reinforcing member disposed on or in the vicinity of the discharge seal to reinforce the discharge seal, and that the reinforcing member be formed by adhering the interior surfaces that face to each other in the container body. If such a reinforcing member is provided, it is possible to prevent the discharge seal from accidentally opening, when an impact pressure is given to the container, for example, by dropping the container.

The partition seal may be formed to comprise at least one protruding portion that projects toward the adjacent chamber. Providing such a projection makes it possible to readily open the sealed portion, because when pressure is applied to the chamber, the projection starts peeling at low pressure.

It is also possible to form at least one of the partition seal and the discharge seal by making a convex strip provided on one of the interior surfaces of the container and a concave channel provided on the facing interior surface that detachably interdigitate with each other by elastic deformation. Such a structure achieves the following effects. When the sealing portion is formed by heat sealing films, if medicament is disposed on the surface to be sealed, satisfactorily sealing strength may not be obtained. However, if the sealed portion is formed by the above-described convex strip/concave channel interdigitation, even when a medicament is disposed on the surface to be sealed, a reliable unsealing strength can be obtained.

BEST MODE FOR CARRYING OUT THE INVENTION

Embodiments of the multiple-chamber medical container according to the present invention will be illustrated below with reference to the drawings. In the following description, the same number is given to similar or identical parts in each of the embodiments.

Figure 1:
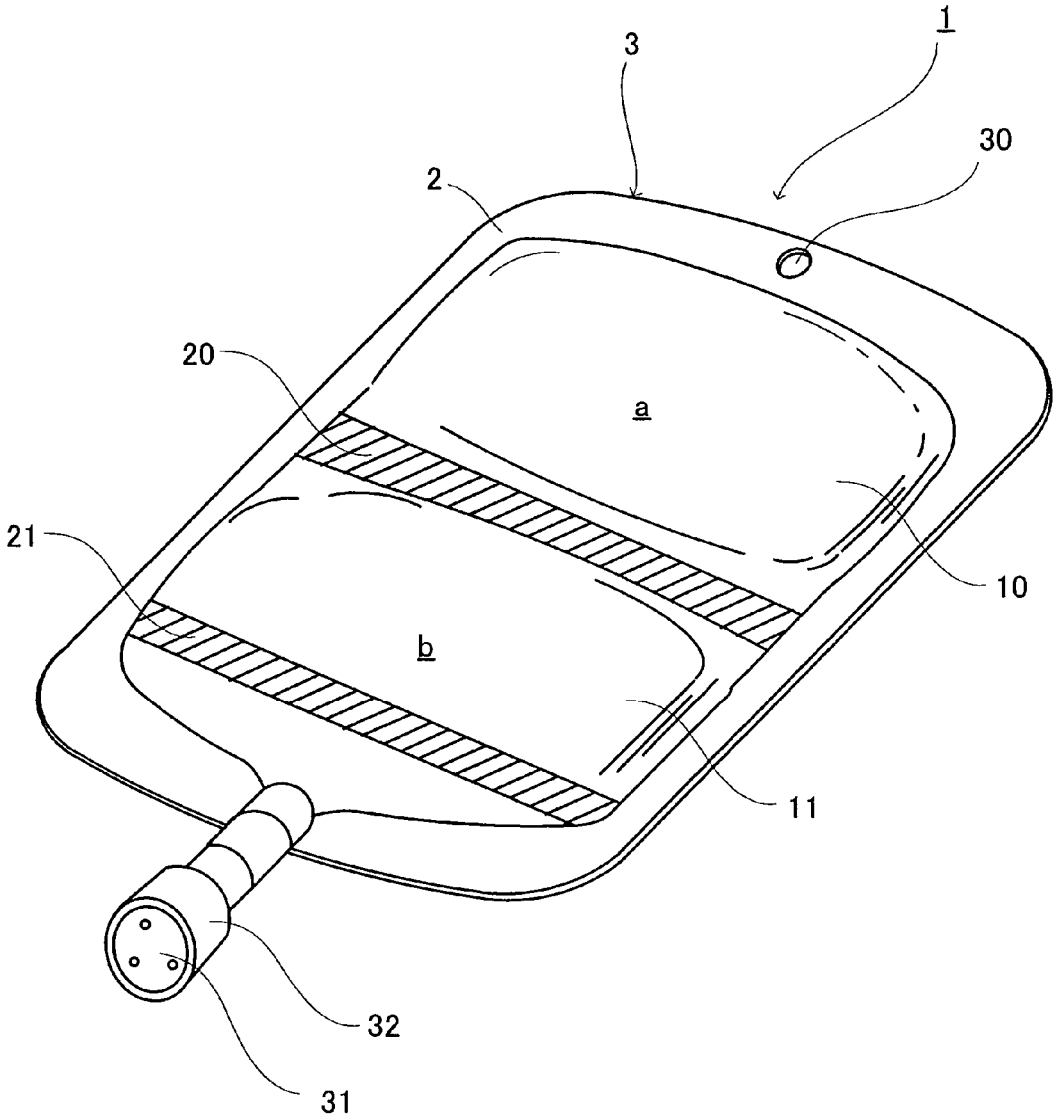
FIG. 1 is a perspective view showing a first embodiment of the multiple-chamber medical container according to the present invention.
Figure 2:
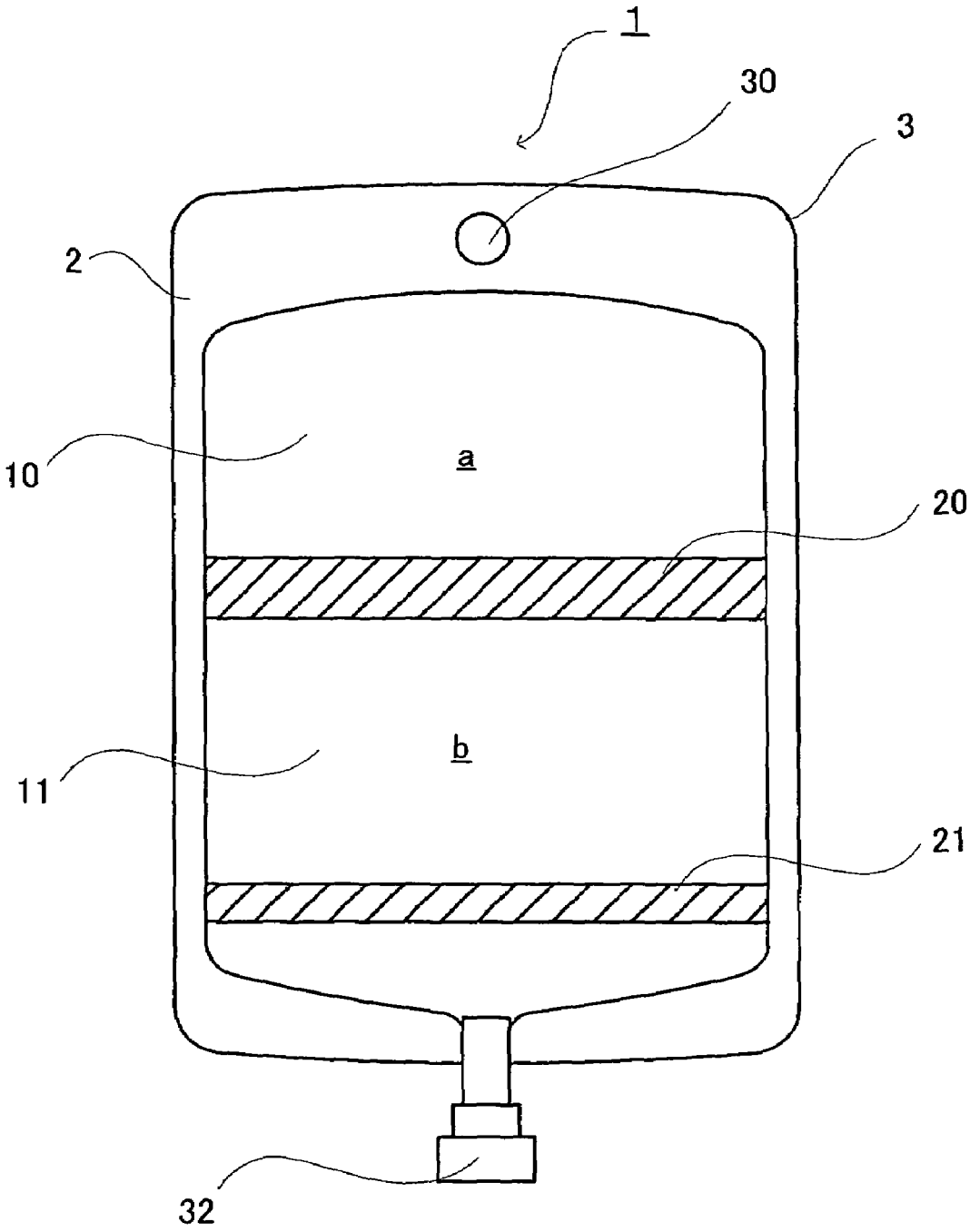
FIG. 2 is a plan view of the multiple-chamber medical container shown in FIG. 1.

The first embodiment of the multiple-chamber medical container according to the present invention will be illustrated in detail. FIG. 1 is a perspective view showing the multiple-chamber medical container according to the first embodiment and FIG. 2 is a plan view of the multiple-chamber medical container shown in FIG. 1.

As shown in FIG. 1, a multiple-chamber medical container 1 comprises a container body 3 formed approximately in the shape of a rectangle and an outlet 32 for discharging a medicament which is connected to the container body 3 and which has a rubber plug 31 inside. The container body 3 has a first chamber 10 and a second chamber 11 which are arranged in line longitudinally, and the two chambers 10 and 11 are separated from each other by an openable weak partition seal (partition seal) 20. The outlet 32 is connected to the second chamber 11, and the outlet 32 and the second chamber 11 are separated from each other by an openable weak discharge seal (discharge seal) 21. Each of the chambers 10 and 11 contains a medicament a and b respectively, which are desired to be prevented from being mixed or dissolved together in advance. For example, the chambers 10 and 11 may contain an amino acid transfusion solution and a glucose transfusion solution, respectively.

The container body 3 is formed in the shape of a bag by heat-sealing or otherwise adhering the peripheral portions of two single-layered or multi-layered films. Materials for the films may be selected from various resins used as raw materials for medical container, such as polyethylene, polypropylene, polystyrene and like thermoplastic resins.

Figure 3:
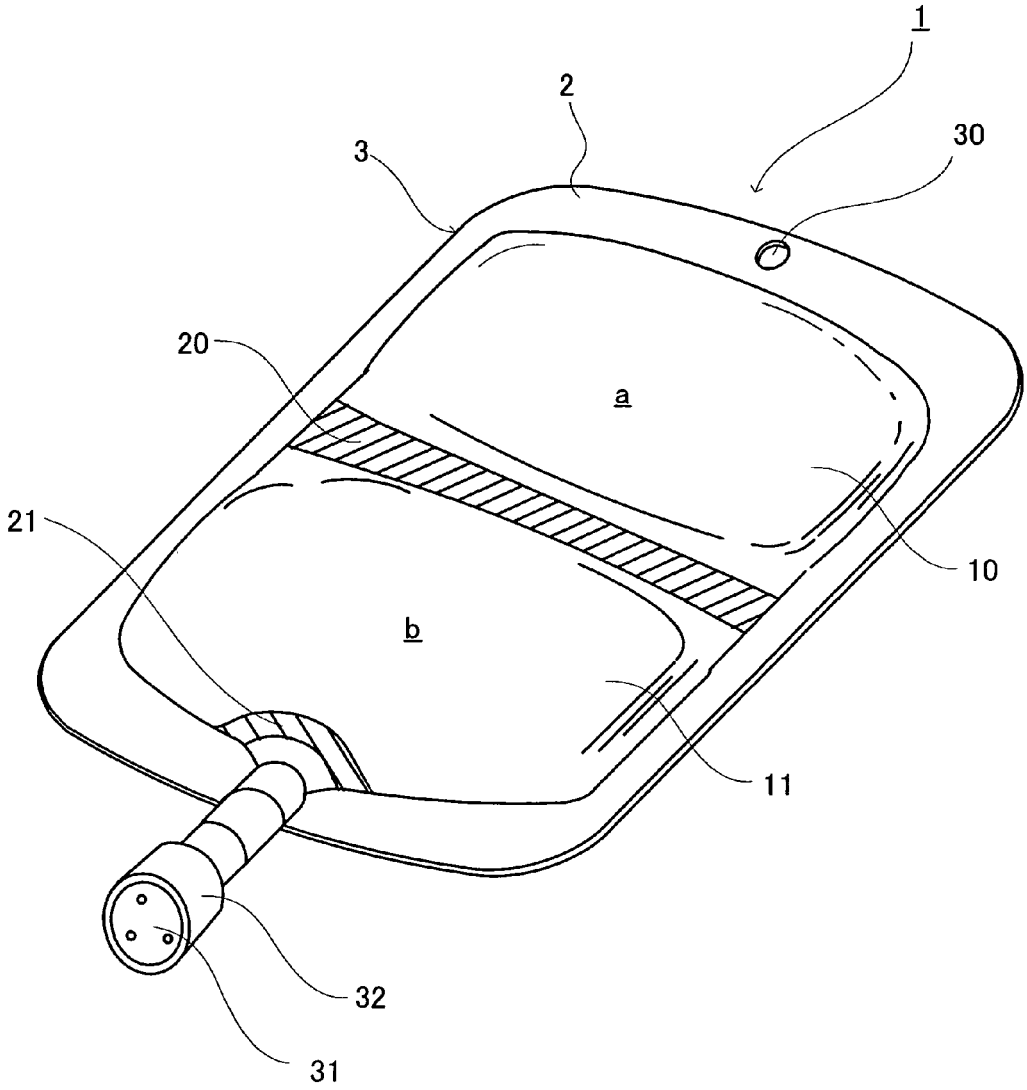
FIG. 3 is a plan view showing another example of a multiple-chamber medical container according to the first embodiment.

The weak partition seal 20 and the weak discharge seal 21 are formed by heat-sealing the interior facing films of container body 3. The weak discharge seal 21 may be, for example, disposed parallel to the weak partition seal 20 as shown in FIG. 1, or may be formed arcwise around the outlet 32 as shown in FIG. 3. When the weak discharge seal 21 is formed into an arcwise shape, the sealed area is reduced, decreasing the time and cost of production. Moreover, because the sealed area is small, creases are not readily produced in the weak discharge seal 21, reducing the fraction defective.

The unsealing strength required to open the weak discharge seal 21 should be less than that to open the weak partition seal 20. The "unsealing strength" is the strength required to open at least one portion of the weak seal 20 or 21 so that the chambers partitioned by the weak seal 20 or 21 can be communicated. The unsealing strength can be measured by various methods. For example, it can be defined as the amount of force applied to open each weak seal by pressing a disc having a diameter of 100 mm against each of two portions of the container body having the same capacity. In this case, it is preferable that the pressure required to open the weak discharge seal 21 is lower than that for the weak partition seal 20 by 5-10 kg.

Illustrated below is the use of the multiple-chamber medical container having above-mentioned structure. To administer medicaments held in the container to a patient, pressure is applied on the first chamber 10 by pressing with the hand or like to increase the internal pressure of the chamber 10. The weak partition seal 20 is thereby opened so that the first chamber 10 and the second chamber 11 communicate with each other, and the medicaments a and b in chambers 10 and 11 respectively are mixed together. After a needle of an infusion tube is inserted into the rubber plug 31 in the outlet 32, the entire surface of the first and second chambers 10 and 11 is pressed to increase the internal pressure of the chambers 10 and 11 that are communicably opened, and the weak discharge seal 21 is then opened. In this case, the needle may also be inserted into the plug after opening the weak discharge seal 21. In this manner, the mixed medicament in the container 1 is administered via the outlet 32 through the infusion tube to the patient.

Alternatively, it is possible to open the seals by pressing the second chamber 11. In other words, when the second chamber 11 is pressed, because a difference in the unsealing strength exists between the seals, weak discharge seal 21 is opened first. In this case, when the second chamber 11 is pressed further, the weak partition seal 20 is then opened and the chambers 10 and 11 communicate with each other, and thus the medicaments in the chambers 10 and 11 are mixed. In this case, the weak seals 20 and 21 are opened merely by maintaining pressure on the second chamber 11, and therefore the operation is simplified. When a needle from the infusion tube is inserted into the rubber plug 31 in the outlet 32, the medicament mixture is administered to the patient from the medicament outlet 32 via the infusion tube.

Thus, according to the present embodiment, the weak discharge seal 21 is provided so that the second chamber 11 and the outlet 32 do not directly communicate with each other. Therefore, even if a needle from an infusion tube is accidentally inserted into the outlet 32 before the weak partition seal 20 is opened, the medicament b in the second chamber 11 can be prevented from flowing out of the outlet 32 before mixture. In this case, users can recognize that the weak discharge seal 21 and the weak partition seal 20 are not opened, because the medicament b does not discharge from the outlet 32 even if a needle is inserted. Accordingly, provision of the weak discharge seal 21 can safeguard proper use, i.e. the weak partition seal 20 is opened to mix the medicaments in the chambers, and the medicament mixture is then administered by inserting a needle from an infusion tube into the outlet 32.

In addition, since the strength required to open the weak discharge seal 21 is set lower than that required to open the weak partition seal 20, the following advantages are rendered. As described above, in this container, the weak seals 20 and 21 are opened by pressing one of the first and second chambers 10 and 11. For example, when the first chamber 10 is pressed, the weak partition seal 20 is opened first. Because the chambers 10 and 11 are communicated at this moment, to open the weak discharge seal 21, it is necessary to press the container in such a manner that the pressure will be applied to a wide area, e.g., all over the first and second chambers 10 and 11. If, for example, the unsealing strengths of the weak seals 20 and 21 were the identical or that of the weak discharge seal 21 was greater, to open the weak discharge seal 21, it would be necessary to apply a pressure greater than that required to open the weak partition seal 20 over a wide area, making it difficult to open the seals. When opening the seal is difficult, complicated operations, such as pressing the container while rolling it up, etc., become necessary. In contrast, if the unsealing strength of the weak seal 21 is made less as described above, even if the pressed area is wide, great pressure is unnecessary, making it easy to open the seals.

In contrast, when the second chamber 11 is pressed first, the weak discharge seal 21 is opened first. When pressure on the second chamber 11 is maintained, the weak partition seal 20 is then opened. In other words, both weak seals 20 and 21 can be opened by pressing only the second chamber 11, and the pressed areas are essentially the same. Therefore, great pressure is unnecessary and the seals can be readily opened.

To control the forces required to open the weak discharge seal 21 and the weak partition seal 20, various means as shown below can be used. For example, when the container body 3 is made from polyethylene, the unsealing strength can be controlled by adjusting the sealing strength. To establish the difference in sealing strength, for example, the heat-sealing time for the weak partition seal 20 can be made shorter than that for peripheral portion 2 of the container body 3 and longer than that for the weak discharge seal 21. It is also possible to control the sealing strength by sealing the weak partition seal 20 with a pressure less than that used for sealing the peripheral portion 2 of the container body 3 and greater than that for sealing the weak discharge seal 21. In this case, the peripheral portion 2 of the container body 3 has a sealing strength greater than that of the weak partition seal 20, and therefore it is possible to prevent the peripheral portion 2 of the container body 3 from being opened even after the weak partition seal 20 is opened, preventing the medicaments from leaking out from the chambers 10 and 11.

The above-mentioned sealing strength can be expressed as the peel strength described in JIS-Z0238. The peel strength indicates the strength required to peel a weak seal having a width of 15 mm, i.e., the strength required to separate the heat-sealed surfaces of two films. In this case, it is preferable that the peel strength of the weak partition seal 20 be set at 1 N/15 mm to 7 N/15 mm, and the peel strength of the weak discharge seal 21 be set less than that by 0.1 N/15 mm to 0.9 N/15 mm and more preferably by 0.1 N/15 mm to 1 N/15 mm.

When at least the innermost layer of the container body is formed from two or more thermoplastics having low miscibility with one another and different melting points, it is possible to readily establish difference in sealing strength. Examples of such plastics include mixtures of polyethylene and a member selected from styrene-based resins, methacrylate ester-based resins, poly-4-methylpentene, polyesters, polyamides and polypropylene. Among these, polyethylene and polypropylene are especially preferable because their safety for medical usage has been confirmed and their handling procedures during the production of chambers is established. The mixing ratio of polyethylene and polypropylene is not especially limited but is generally selected from within the range of 1:9 to 9:1.

Furthermore, it is also possible to ensure the unsealing strength of the weak discharge seal 21 is less than that required to open the weak partition seal 20 by adjusting the widths of seals 20 and 21. The unsealing strength of the weak discharge seal 21 can be weakened by making at least one portion of the width of weak discharge seal 21 narrower than the width of weak partition seal 20. This makes it possible to establish a difference in unsealing strength between the weak seals 20 and 21 while keeping the same level of sealing time or sealing pressure for the seals 20 and 21, reducing the time and cost for production of the container 1. The number of portions where the weak discharge seal 21 is narrowed may be single or plural. It is also possible to make the entire width of the weak partition seal narrow.

Figure 4:
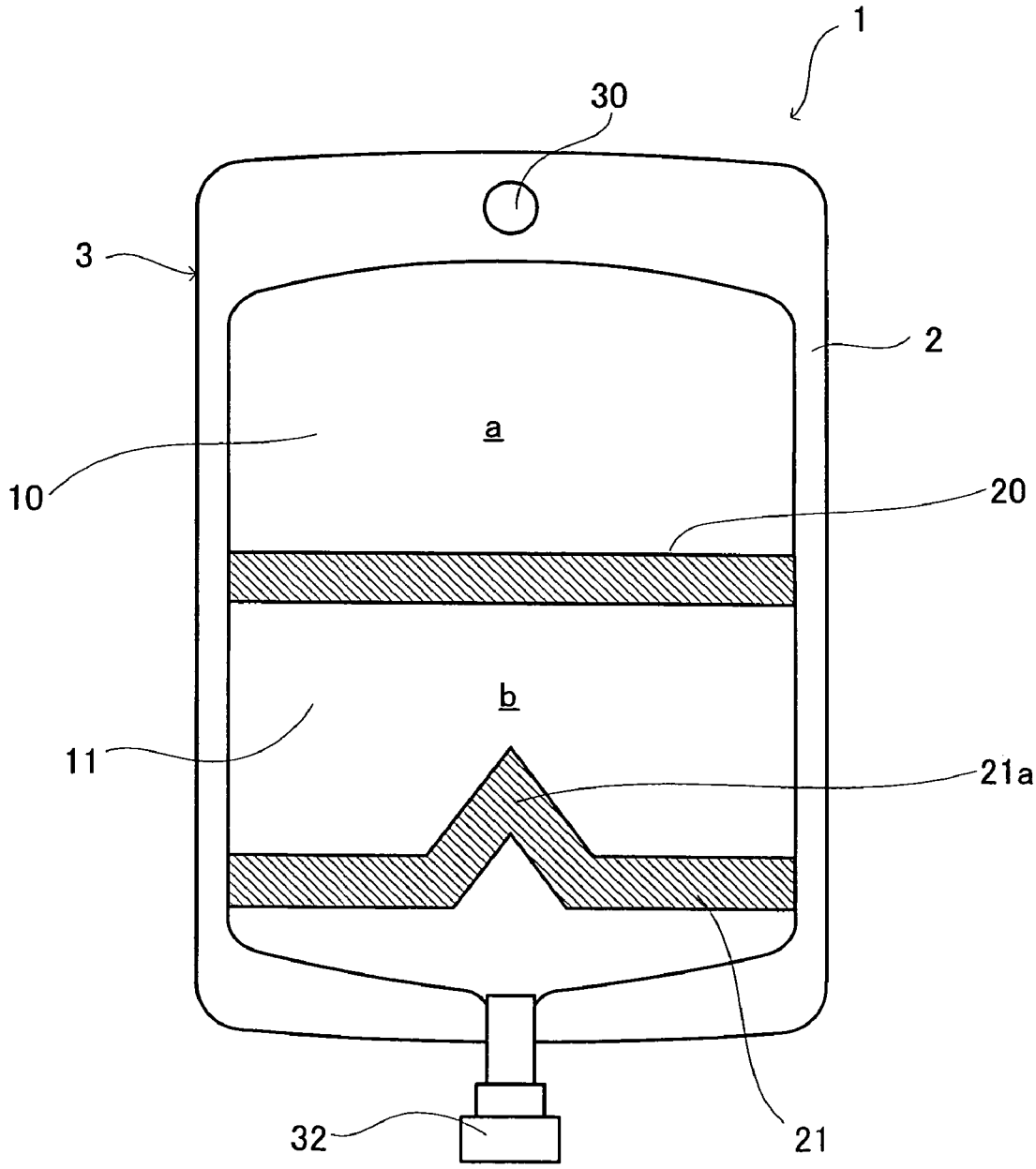
FIG. 4 is a plan view showing a second embodiment of the multiple-chamber medical container according to the present invention.
Figure 5:
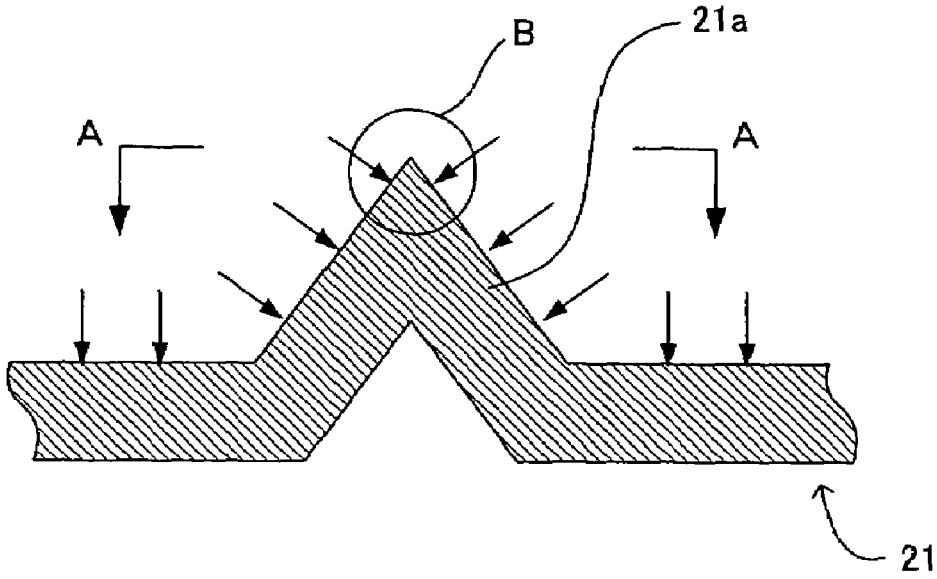
FIG. 5 illustrates the action of a protruding portion of the weak partition seal of the second embodiment.
Figure 5:
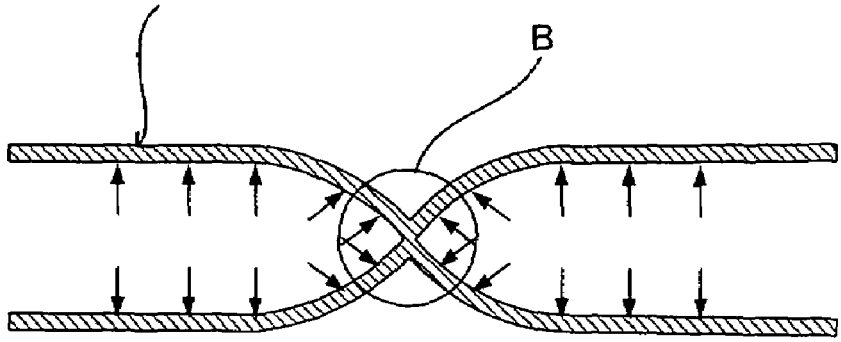

It is also possible to make the pressure required to open the weak discharge seal relatively low by providing a projection to the weak discharge seal. This second embodiment of the present invention is explained below. FIG. 4 is a plan view of a medical multi-chamber container of the second embodiment. FIG. 5(*a*) is a plan view explaining the operation of the projection, and FIG. 5(*b*) is the cross-sectional view taken along the line A-A of FIG. 5(*a*).

In the medical multi-chamber container 1 as shown in FIG. 4, the weak partition seal 20 and the weak discharge seal 21 have the same width and are sealed for the same sealing time under the same sealing pressure. The weak discharge seal 21 incorporates a V-shaped projection 21*a* in the center that faces the second chamber 11. As described below, the projection 21*a* reduces the pressure required to open the weak discharge seal 21.

As shown in FIG. 5(*a*), when the internal pressure of the chamber 10 or 11 increases, the weak discharge seal 21 receives pressure in the directions as indicated by the arrows. At this time, because the pressure acts perpendicularly and uniformly over the weak discharge seal 21, total pressure acting on the area in the vicinity of the apex B of the projection 21*a* becomes relatively greater than on other areas of the weak discharge seal 21. The pressure thereby acts to separate the films that compose the container body 3 as shown in FIG. 5(*b*), and therefore, when the internal pressure of the chamber 10 or 11 is increased, the weak discharge seal 21 starts opening from the vicinity of the apex B of the projection 21*a*. Opening of the seal quickly progresses under the action of the pressure, and the second chamber 11 and the outlet 32 become communicably opened.

As described above, in the present embodiment, because the weak discharge seal 21 is provided with a V-shaped projection 21*a*, when pressure is applied to the chambers 10 and 11, the projection 21*a* starts opening even with small pressure and this makes it possible to readily open the weak discharge seal 21. Therefore, it is possible to open the weak discharge seal 21 with less pressure than is necessary to open the weak partition seal 20.

Moreover, in the present embodiment, because it is possible to reduce the pressure required to open the weak discharge seal 21 merely by changing the shape of the weak discharge seal 21, sealing of the weak seals 20 and 21 can be conducted under the same conditions without changing the sealing time, etc. As a result, reductions of time and cost in producing the container 1 can be achieved. In particular, because the weak partition seal 20 and the weak discharge seal 21 have the same width, uneven sealing can be prevented and the entire weak seals 20 and 21 can be sealed uniformly.

The number of the projections 21*a* is not limited to one and may be two or more. Furthermore, each projection 21*a* may be formed into shapes other than V-shaped as long as it has a projecting portion at which pressure tends to focus. As long as an appropriate difference in unsealing strength is established, it is possible to provide projections both on the weak partition seal 20 and the weak discharge seal 21. It is also possible to provide a projection only on the weak partition seal 20.

Figure 6:
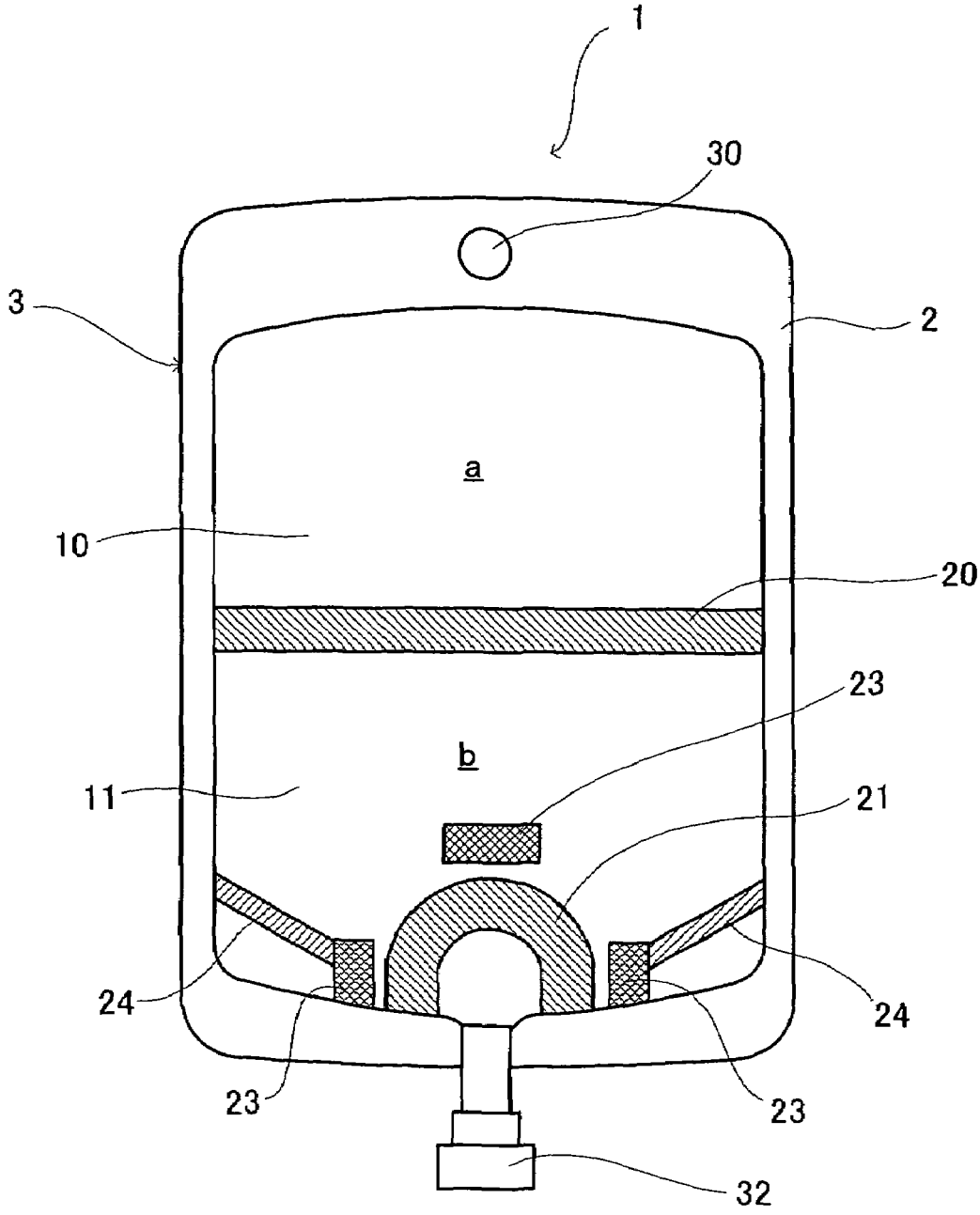
FIG. 6 is a plan view showing a third embodiment of the multiple-chamber medical container according to the present invention.
Figure 7:
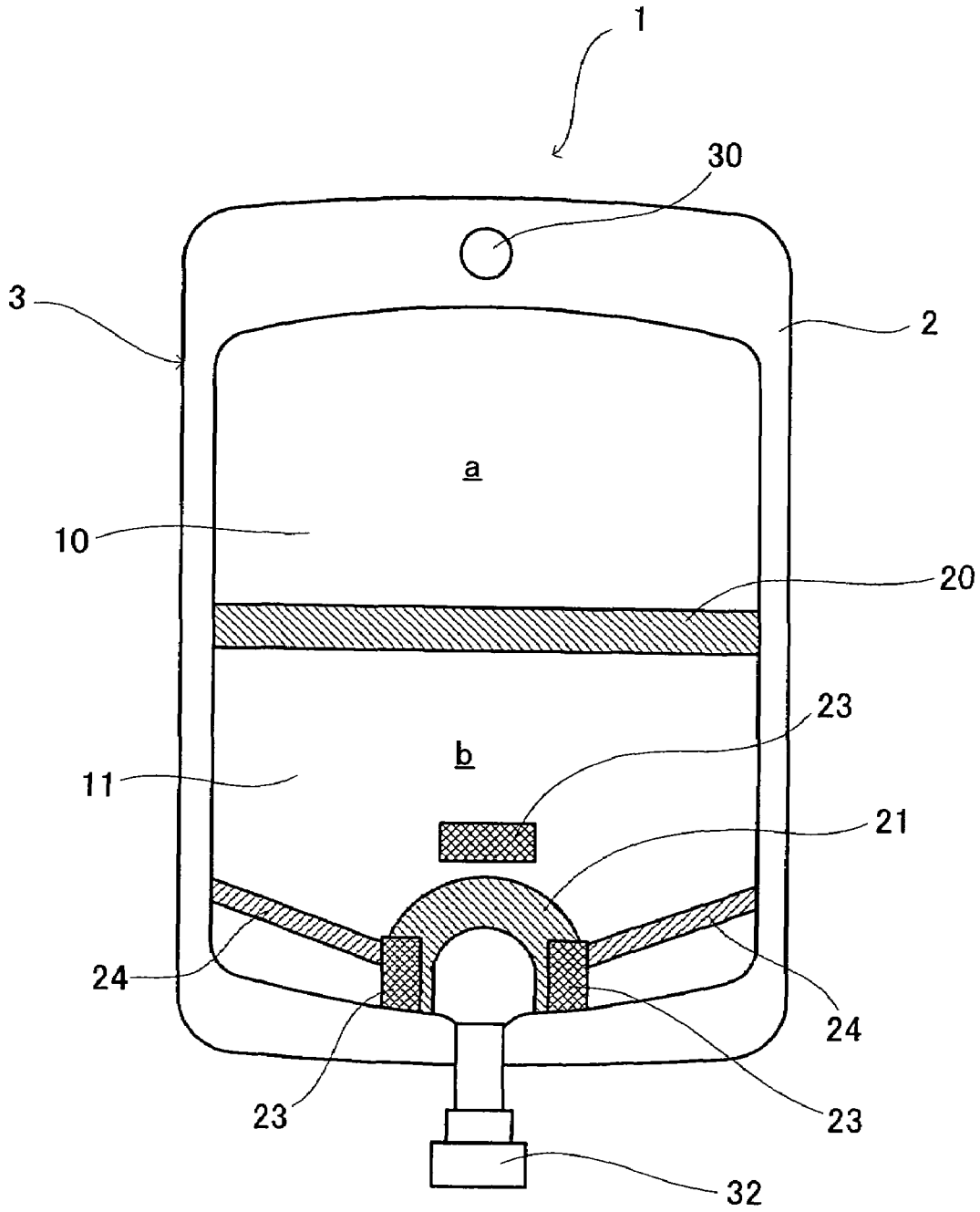
FIG. 7 is a plan view showing another example of a multiple-chamber medical container according to the third embodiment.

When the unsealing strength of the weak discharge seal 21 is made small as described above, for example, when the container 1 is accidentally dropped, the weak discharge seal 21 may be opened by the shock. Therefore, to reinforce the weak discharge seal 21, it is possible to provide a reinforcing seal as described below. This third embodiment of the present invention is explained below with reference to the drawings. FIG. 6 is a plan view of a medical multi-chamber container of the third embodiment.

As shown in FIG. 6, in the present embodiment, a weak discharge seal 21 is formed arcwise around the outlet 32. A rectangular reinforcing seal (reinforcing member) 23 is disposed in each of three locations, i.e., both ends of the weak discharge seal 21, and away from the apex at a predetermined distance. These reinforcing seals 23 have almost the same unsealing strength as the peripheral portion 2 of the container body 3, i.e., stronger than the weak seals 20 and 21 and do not open under normal usage, in the same manner as the peripheral portion 2.

Guide seals 24 that extend to the peripheral portion 2 of the container body 3 are connected to the pair of reinforcing seals 23 that are disposed on each side of the weak discharge seal 21. These guide seals 24 have an unsealing strength almost the same as the reinforcing seals 23 and discharges all the medicament contained in the first chamber 1 by making the medicament in the second chamber 11 flow to the outlet 32 when the weak discharge seal 21 opens.

In a medical multi-chamber container 1 having the above structure, because the reinforcing seals 23 are provided around the weak discharge seal 21, for example, when the container 1 is accidentally dropped on the floor and an impact is applied to a side of the container 1, the reinforcing seal 23 intercepts the impact and prevents it from being transferred to the weak discharge seal 21. As a result, it is possible to prevent the weak discharge seal 21 from being opened by relatively small impact pressures. Because a reinforcing seal 23 is also disposed in the position facing the apex of the weak discharge seal 21, it effectively affects on impacts applied from the longitudinal direction of the container 1. Therefore, it is possible to prevent the weak discharge seal 21 from being accidentally opened before use.

As well as disposing reinforcing seals 23 in locations at a predetermined distance from the weak discharge seal 21, these reinforcing seals 23 may be provided on the edge of the weak discharge seal 21 after completion of sealing the weak discharge seal 21.

In each of the embodiments described above, the multiple-chamber medical container is provided so that two kinds of medicaments can be mixed. However, this does not constitute a limitation and the multiple-chamber medical container may comprise two or more chambers.

Figure 8:
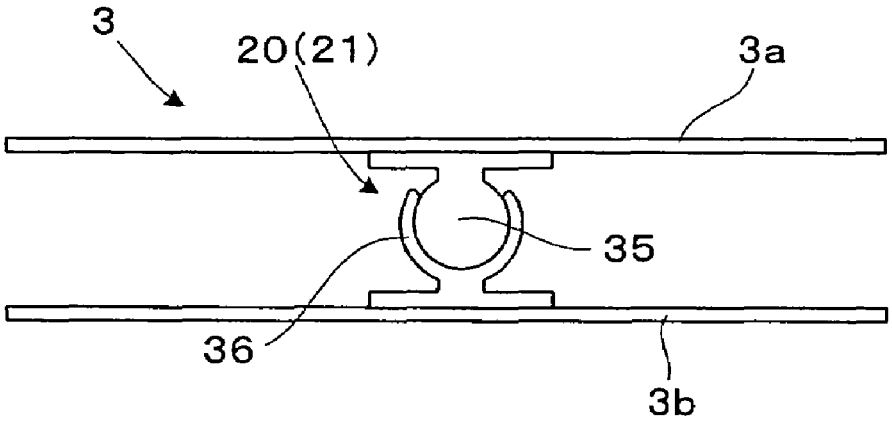
FIG. 8 is a cross-sectional view showing other examples of the weak partition seal.
Figure 8:
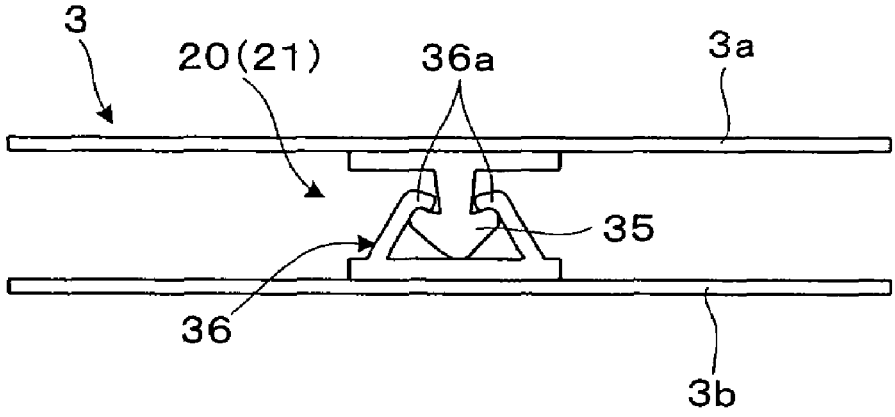

Moreover, each of the above embodiments of the present invention provides sealed portions as weak seals 20 and 21 prepared by heat-sealing the films. However, these portions may be constructed as follows. As shown in FIG. 8(*a*), the multiple-chamber container may comprise a convex strip 35 having a circular profile on the surface 3*a*, which is one of a pair of interior facing films of the container body 3, and a U-shaped concave channel 36 on the surface 3*b*, which is the other film. The seals 20 and 21 are constructed so that they interdigitate and can be disjointed by elastic deformation. As in the above embodiments, the unsealing strength of the discharge seal 21 is set less than that of the partition seal 20. By forming the seals 20 and 21 by the interdigitation of the convex strip 35 and the concave channel 36, the following effects can be achieved. When a sealing portion is formed by heat-sealing films, if medicament powder or liquid, etc., is disposed on the surface to be sealed, satisfactory heat-sealed strength may not be obtained. In contrast, when the sealing portion is formed by the concavo-convex interdigitation as described above, even when medicament is disposed on the surface to be sealed, a certain sealing strength can be obtained.

A difference in unsealing strengths of the concavo-convex interdigitation can be established in various ways. For example, when the concave channel 36 is made thick, it is difficult to elastically deform, enhancing the unsealing strength. Alternatively, by providing small irregularities on the interdigitating surface of the convex strip 35 or the concave channel 36 to increase friction between the convex strip 35 and the concave channel 36, it is possible to increase the unsealing strength.

The shapes of the convex strip 35 and the concave channel 36 are not limited to the above and may be any shape as long as the convex strip 35 and the concave channel 36 detachably interdigitate. For example, as shown in FIG. 8(*b*), it is possible to form the convex strip 35 with an aduncate profile and form the concave channel 36 with a retaining portion 36*a* that can suitably retain the convex strip 35. The convex strip 35 and the concave channel 36 may be formed by attaching separately prepared parts to the surfaces of the films as shown in FIG. 8. It is also possible to form them integral with the film surfaces 3*a* and 3*b*.

Figure 9:
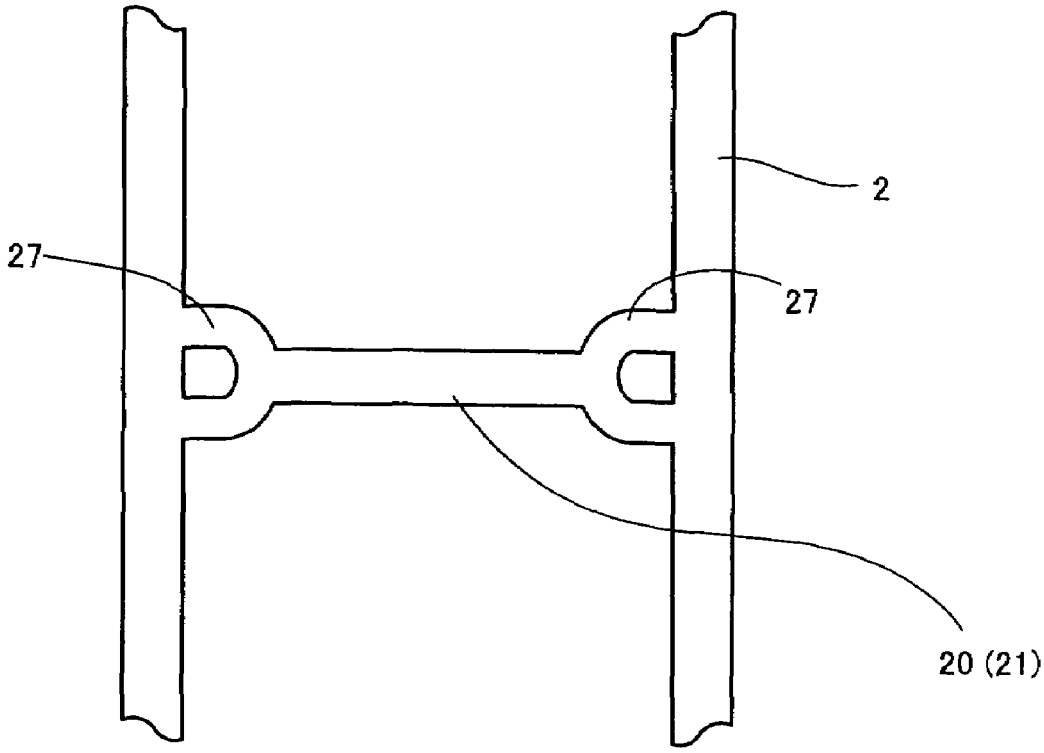
FIG. 9 shows an example of a connection between the weak partition seal and the periphery of the container.
Figure 10:
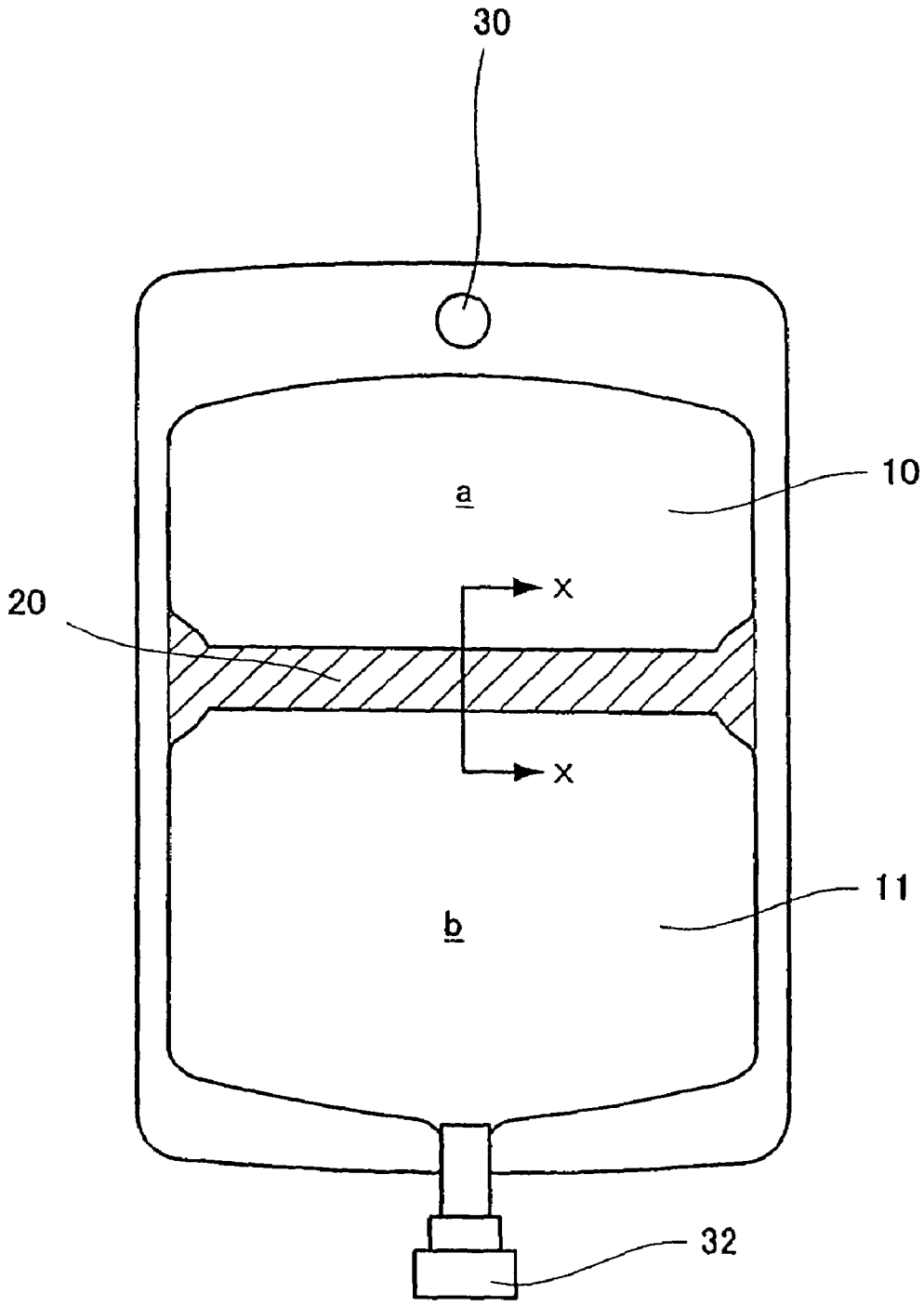
FIG. 10 is a plan view showing an example of a conventional multiple-chamber medical container.
Figure 11:
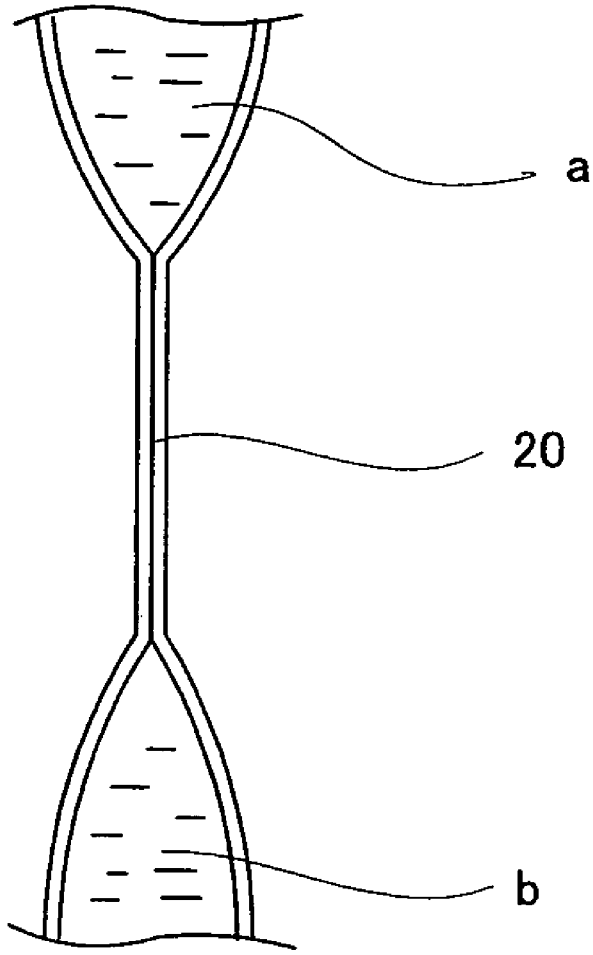
FIG. 11 is a cross-sectional view in the direction of the arrows taken along the X-X line of FIG. 10.

In the above embodiments, the weak seals (partitions) 20 and 21 may be connected to the peripheral portions 2 through U-shaped seals 27 as shown in FIG. 9. This reduces the occurrence of pinholes during sealing compared to the case where the edges of the weak seals 20 and 21 are directly connected to the peripheral portions 2.

The invention claimed is:

1. A multiple-chamber medical container comprising:

a container body having multiple chambers for storing medicaments and a partition seal separating the chambers from each other; and an outlet attached to the container body for allowing the medicaments to be discharged from one of the chambers, wherein the partition seal is openable so that the chambers may communicate with each other at the time of use;

the container body comprises a discharge seal that separates at least one chamber from the outlet and is openable at the time of use, the unsealing strength of the discharge seal is less than that of the partition seal, and the peel strength of the partition seal is set at 1 N/15 mm to 7 N/15 mm, and the peel strength of the discharge seal is set less than that by 0.1 N/15 mm to 1 N/15 mm.

2. A multiple-chamber medical container according to claim 1, wherein at least an innermost layer of the container body comprises a film prepared from a mixture of two or more kinds of thermoplastics having low miscibility with one another and different melting points, the peripheral portion thereof being heat-sealed to form the container body in the shape of a bag;

the partition seal and the discharge seal being formed by heat-sealing the interior surfaces of the film of the container body that are facing each other; and the partition seal having a sealing strength less than that of the peripheral portion of the container body and higher than that of the discharge seal.

3. A multiple-chamber medical container according to claim 2, wherein at least the innermost layer of the container body is formed from a film prepared from a mixture of polyethylene and polypropylene or of polyethylene and an cyclic olefin resin.

4. A multiple-chamber medical container according to claim 1, which further comprises a reinforcing member disposed on or in the vicinity of the discharge seal to reinforce the discharge seal, the reinforcing member being formed by adhering the interior surfaces that face to each other in the container body.

5. A multiple-chamber medical container according to claim 1, wherein the discharge seal is provided with at least one projecting portion that projects toward the chamber.

6. A multiple-chamber medical container according to claim 1, wherein at least one portion of the discharge seal has a narrower width than that of the partition seal.

7. A multiple-chamber medical container according to claim 1, wherein the partition seal is provided with at least one projecting portion that projects toward the chamber.

8. A multiple-chamber medical container according to claim 1, wherein at least one of the partition seal and the discharge seal is formed by interdigitating a convex strip on one of the interior surfaces of the container and a concave channel on the other interior surface, the seal being able to be disjoined by elastic deformation.

9. The multiple-chamber medical container according to claim 1, wherein the discharge seal is formed arcwise around the outlet.

10. The multiple-chamber medical container according to claim 1, wherein the pressing force required to open the partition seal, when pressing a disc having a diameter of 100 mm against the container body, is greater than that of the discharge seal by 5-10 kg.

11. The multiple-chamber medical container according to claim 2, wherein the partition seal and/or discharge seal is connected to the peripheral portion through U-shaped seal.

* * * * *